US008430645B2

(12) United States Patent
Jannausch et al.

(10) Patent No.: US 8,430,645 B2
(45) Date of Patent: Apr. 30, 2013

(54) TWO STAGE PRESSURE REGULATION SYSTEM FOR VARIABLE DISPLACEMENT HYDRAULIC PUMPS

(75) Inventors: Matthew J. Jannausch, Berkley, MI (US); Douglas G. Hunter, Troy, MI (US)

(73) Assignee: SLW Automotive Inc., Sallisaw, OK (US)

( * ) Notice: Subject to any disclaimer, the term of this patent is extended or adjusted under 35 U.S.C. 154(b) by 835 days.

(21) Appl. No.: 12/438,797

(22) PCT Filed: Sep. 6, 2007

(86) PCT No.: PCT/US2007/019392

§ 371 (c)(1),
(2), (4) Date: Nov. 16, 2009

(87) PCT Pub. No.: WO2008/030491

PCT Pub. Date: Mar. 13, 2008

(65) Prior Publication Data

US 2010/0080724 A1 Apr. 1, 2010

Related U.S. Application Data

(60) Provisional application No. 60/843,143, filed on Sep. 8, 2006.

(51) Int. Cl.
*F04B 49/00* (2006.01)
*F04B 1/06* (2006.01)

(52) U.S. Cl.
USPC ..... 417/220; 417/212; 417/213; 418/26; 418/31

(58) Field of Classification Search ..... 417/212, 417/213, 219, 220; 418/26, 30, 31
See application file for complete search history.

(56) References Cited

U.S. PATENT DOCUMENTS

| | | | | |
|---|---|---|---|---|
| 4,678,412 | A | 7/1987 | Dantlgraber et al. | |
| 5,562,432 | A | 10/1996 | Semba et al. | |
| 7,018,178 | B2 * | 3/2006 | Hunter et al. | 417/219 |
| 7,396,214 | B2 | 7/2008 | Hunter et al. | |
| 2003/0231965 | A1 * | 12/2003 | Hunter et al. | 417/212 |

FOREIGN PATENT DOCUMENTS

| | | |
|---|---|---|
| JP | 2001 140772 | 5/2001 |
| JP | 2004 218527 | 8/2004 |
| WO | WO 2006/066405 A1 | 6/2006 |
| WO | WO 2007/123607 A1 | 11/2007 |

* cited by examiner

*Primary Examiner* — Peter J Bertheaud
(74) *Attorney, Agent, or Firm* — Warn Partners, P.C.

(57) ABSTRACT

A pump having a housing with an actuator member positioned inside for controlling the flow generated by the pump. A first decrease port is connected to the housing and has a surface area in operable contact with the actuator member. A second decrease port is connected to the housing and has a surface area that is operable contact with the actuator member. A valve is connected to the second decrease port for controlling the flow of fluid to the second decrease port. A suction passage is connected to the housing and drawings fluid to the housing using the actuator member. A discharge passage is connected to the housing so that fluid providing an exit for fluid that has been pressurized by the actuator member.

23 Claims, 3 Drawing Sheets

TWO STAGE PRESSURE REGULATION SYSTEM FOR VARIABLE DISPLACEMENT HYDRAULIC PUMPS

CROSS-REFERENCE TO RELATED APPLICATIONS

This application claims the benefit of U.S. Provisional Application No. 60/854,143, filed Sep. 8, 2006.

FIELD OF THE INVENTION

The present invention generally relates to the control of the output of a variable flow pump.

BACKGROUND OF THE INVENTION

It is desirable to properly lubricate the moving components in an internal combustion engine and provide hydraulic power. Typically, oil pumps used in engines are operably associated with the crankshaft of the engine (e.g., direct driven, chain driven, gear driven and/or the like) and have relatively simple fixed pressure regulation systems. While these systems are generally adequate, there are some disadvantages. For example, there is not much control of the actual discharge pressure relative to the pressure needed by the engine under certain/given operating conditions. By way of a non-limiting example, currently available pump technology typically provides high oil pressure at all engine operating conditions, where a lower oil pressure may be adequate at some of those engine conditions. Developing arrangements that provide less than high pressure outputs are desirable.

In commonly-assigned U.S. Pat. No. 6,896,489, the entire specification of which is expressly incorporated herein by reference, a mechanical hydraulic arrangement is shown for providing control of a variable displacement vane pump. This provides for a more optimized control of engine oil pressure. However, it is yet desirable to provide some further control depending on engine needs and/or variables.

SUMMARY OF THE INVENTION

A pump having a housing with an actuator member positioned inside for controlling the flow generated by the pump. A first decrease port is connected to the housing and has a surface area in operable contact with the actuator member. A second decrease port is connected to the housing and has a surface area that is operable contact with the actuator member. A valve is connected to the second decrease port for controlling the flow of fluid to the second decrease port. A suction passage is connected to the housing and draws fluid to the housing using the actuator member. A discharge passage is connected to the housing providing an exit for fluid that has been pressurized by the actuator member.

A further understanding of the present invention will be had in view of the description of the drawings and detailed description of the invention, when viewed in conjunction with the subjoined claims.

BRIEF DESCRIPTION OF THE DRAWINGS

The present invention will become more fully understood from the detailed description and the accompanying drawings, wherein.

DETAILED DESCRIPTION OF THE INVENTION

The following description of the invention is merely exemplary in nature and is in no way intended to limit the invention, its application, or uses.

Figure 1:
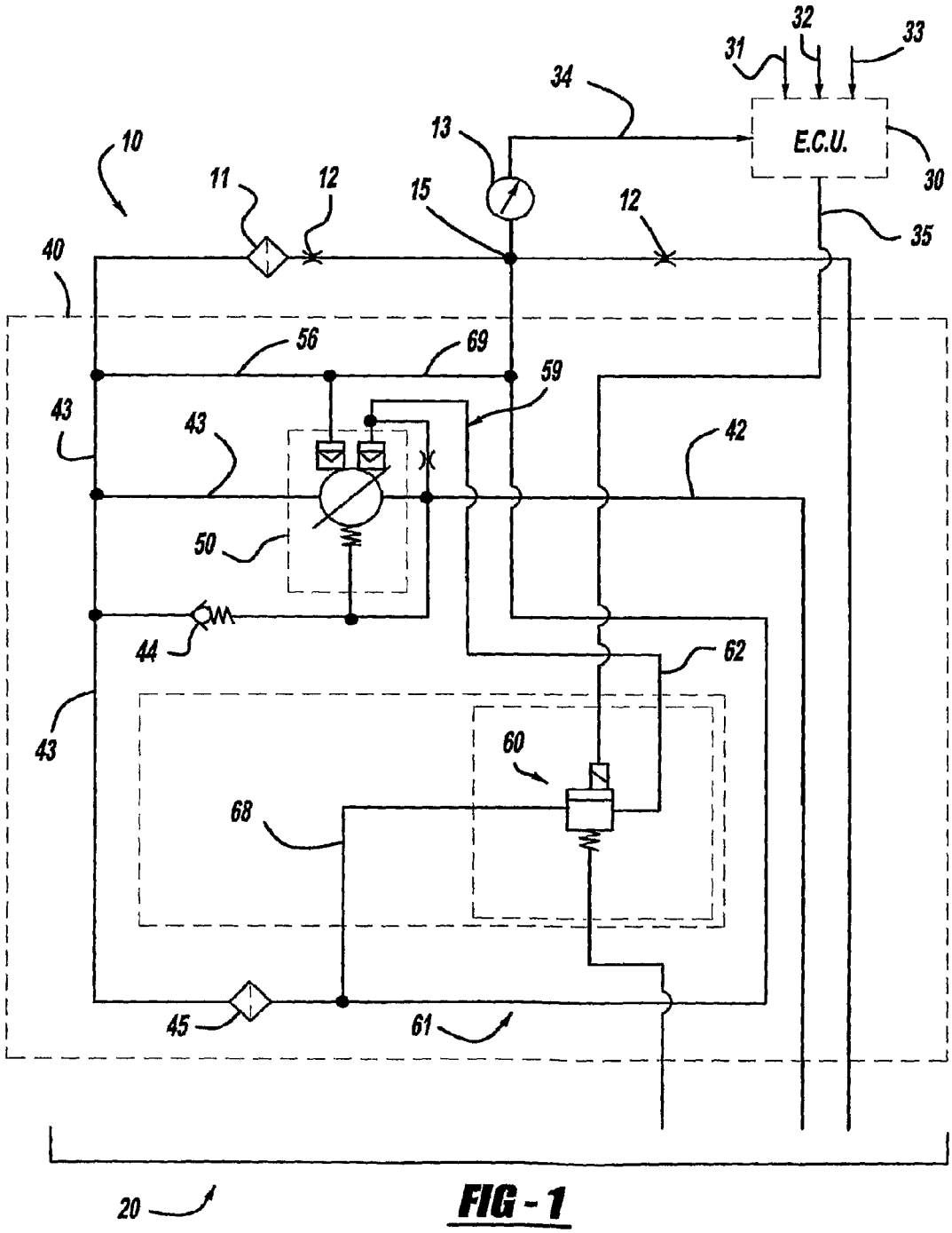
FIG. 1 illustrates a hydraulic schematic of a variable displacement pump system, in accordance with the general teachings of the present invention.
Figure 2:
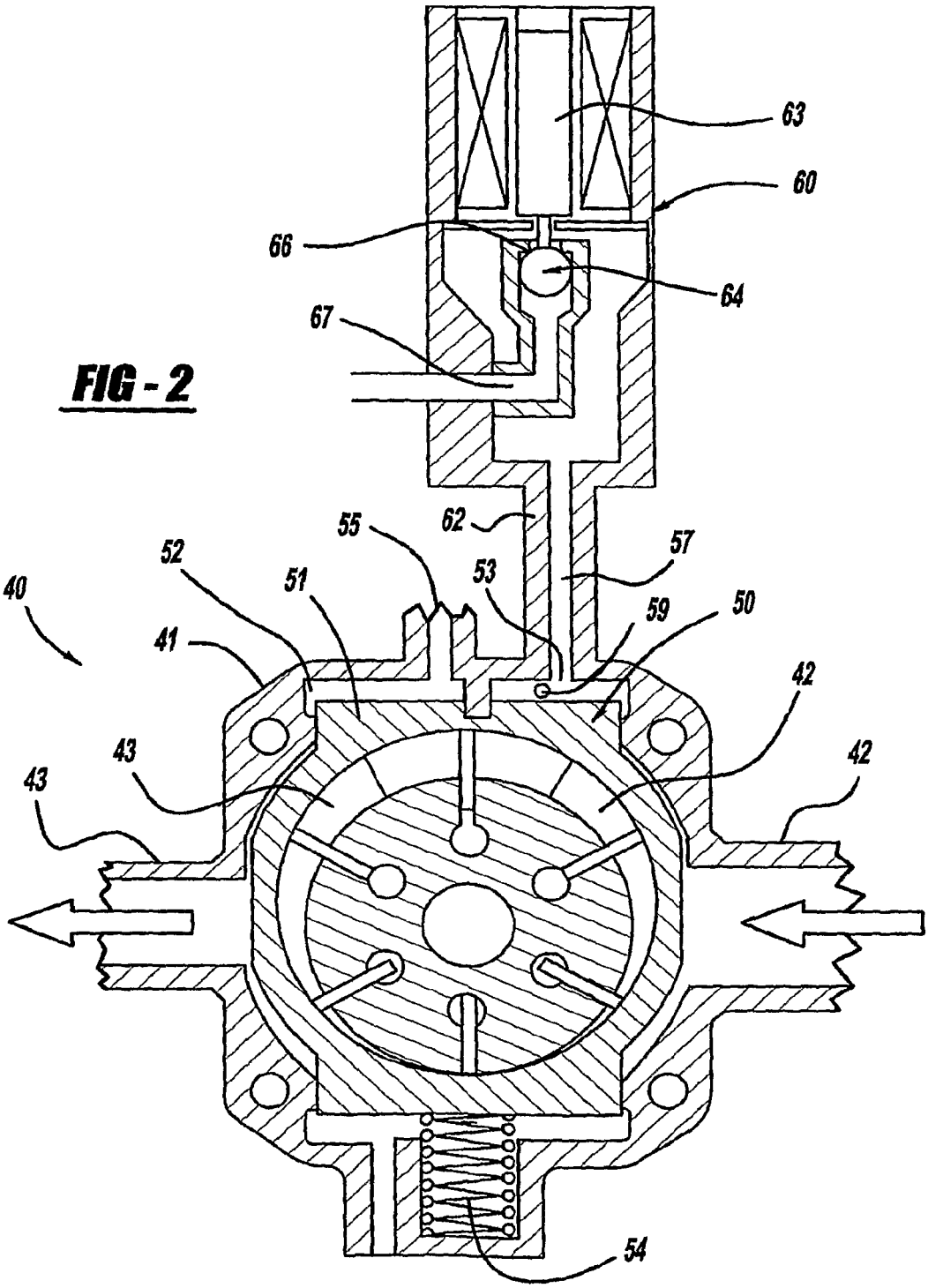
FIG. 2 illustrates a sectional view of a pump, in accordance with a first embodiment of the present invention.

Referring to drawings generally, and specifically to FIGS. 1 and 2, a system and pump arrangement is shown. An oil pump 40 with either a variable displacement pump or a variable output pump element 50. It should be appreciated that other types of pump systems can be used in the present invention, such as but not limited to other types of vane pumps, gear pumps, piston pumps, and/or the like.

In the engine system of the present invention, there is at least a lubrication circuit 10, an oil sump 20, an engine control unit (i.e., ECU) or computer 30, and an oil pump 40 which draws oil from the oil sump 20 and delivers it at an elevated pressure to the lubrication circuit 10.

The lubrication circuit 10 includes at least an oil filter 11 and journal bearings 12 supporting the engine's crankshaft, connecting rods and camshafts, and can contain a variable pressure transducer 13. The lubrication circuit 10 can also optionally contain items such as an oil cooler, piston cooling jets, chain oilers, variable cam timing phasers, and cylinder deactivation systems. The ECU 30 includes electrical inputs for the measured engine speed 31, engine temperature 32, and engine load, torque or throttle 33. The ECU 30 can also have an electrical input for the measured oil pressure 34 from the transducer 13. The ECU 30 also has an output 35 for an electrical control signal to the oil pump 40.

The oil pump 40 includes a housing 41 which contains a suction passage 42, and a discharge passage and manifold 43. The oil pump 40 can also include a pressure relief valve 44 and/or an internal oil filter 45 for cleaning the discharge oil for use inside the oil pump 40. The oil pump 40 contains a variable flow pump element 50, which has a positionable element, such as an eccentric ring 51. The position of the eccentric ring in the pump element 50 determines the flow rate discharged by the pump element 50 at a given drive speed; and which forms in conjunction with the housing 41 two control chambers on the same side of the eccentric ring 51, which contain fluid of controlled pressure for the intended purpose of exerting a control force on an area of the eccentric ring 51. The first chamber or decrease chamber 52, contains pressure applied to the eccentric ring 51 to decrease the flow rate of the variable flow pump element 50 to achieve a high pressure, and the second chamber or decrease chamber 53, contains pressure applied to the eccentric ring 51 to decrease the flow rate of the variable flow pump element 50 to achieve a low pressure. The decrease chamber 52 is separated from the decrease chamber 53 by a wall.

A biasable member such as a spring 54 positioned between the housing 41 and the eccentric ring 51. The spring 54 applies force to the eccentric ring 51 to increase the flow rate of the variable flow pump element 50. The decrease chamber 52 and can be supplied with oil pressure from either the oil pump discharge manifold 43 or some other point downstream in the lubrication circuit 10 (e.g., usually from the main oil gallery 15) that is inputted to the housing 41 through a first decrease port 55. Pressure can be inputted to the second decrease port 57 from either the oil discharge manifold 43 via filter 45 and a channel 62 or some other point downstream in the lubrication circuit 10 (e.g., usually from the main oil gallery 15) via output channel 61. The pressure inputted to the second decrease port 53 can be controlled by a valve 60 which controls the flow of fluid from the sump 20 or from the discharge manifold 43 through a conduit 68 that is connected to the valve 60.

The first decrease port 55 and second decrease port 57 provide separate fixed volumes of pressure that enter the decrease chambers 52 and 53. The amount of pressure that fluid in the decrease chamber 53 applies to the eccentric ring 51 can be controlled by controlling the amount of fluid applied through the second decrease port 57. The second decrease port 57 receives pressure from a conduit 62. The pressure in the conduit 62 is controlled by the valve 60. The valve 60 can be a solenoid valve. As shown in FIG. 2, the valve 60 is a solenoid controlled ball and tappet valve wherein the solenoid portion has a tappet 63 that applies force to move a ball 64 away from a seat 66 to allow pressure to flow from the conduit 68 to the conduit 62. The solenoid 60 can be connected directly to the housing 41 of the pump or it may be placed at a downstream location. It is also possible to use some other type of valve, thus the present application is not limited to a solenoid ball valve application. The amount of pressure applied in the decrease chamber 53 will apply force on the eccentric ring 51 to decrease flow from the manifold 43. The amount of pressure needed to decrease the flow can be predetermined by the force of the spring 54 which must be overcome to move the eccentric ring 51. When pressure is no longer being supplied to the decrease chamber 53, pressure in the chamber can be relieved through exhaust port 59.

Figure 3:
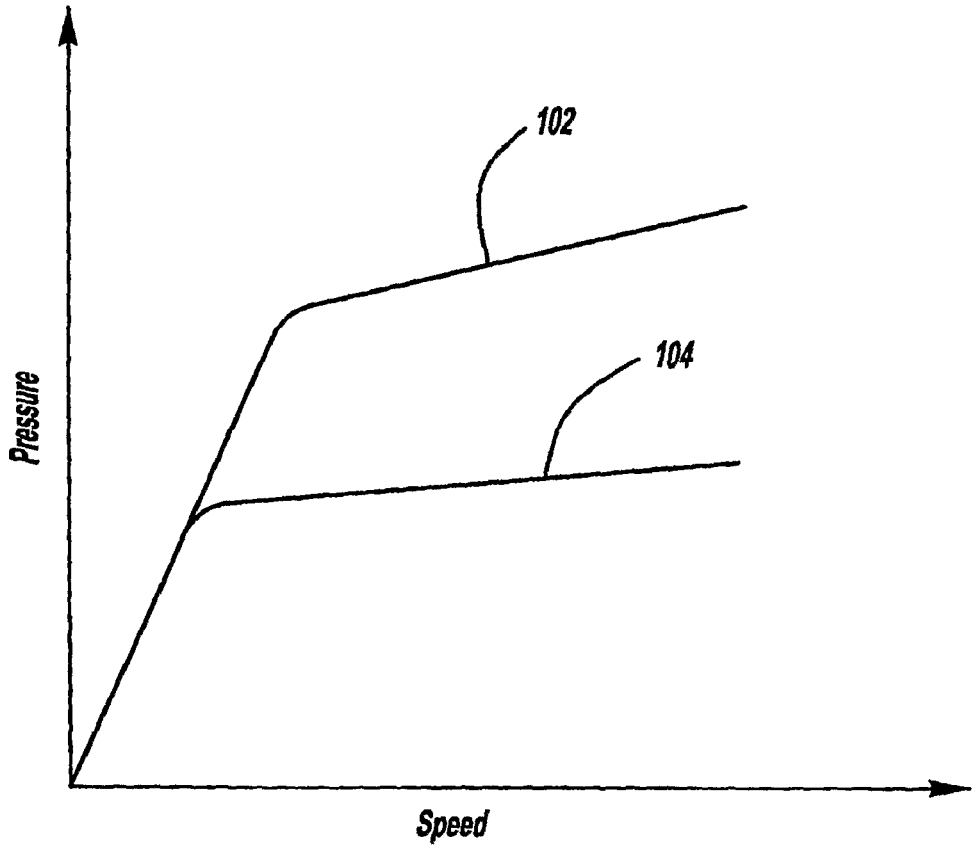
FIG. 3 illustrates a graph showing the performance characteristics of a solenoid valve module.

FIG. 3 graphically illustrates the pressure versus pump speed applied to the eccentric ring 51. A line 102 represents the pressure versus speed line for the first decrease port 55. The second line 104 represents the pressure curve when the first decrease port 55 and second decrease port 57 apply pressure to the eccentric ring 51.

What is claimed is:

1. A pump comprising:

a housing;

an actuator member positioned within said housing for controlling the flow generated by said pump;

a first decrease port connected to said housing, said first decrease port having a surface area in operable contact with said actuator member;

a second decrease port connected to said housing having a surface area in operable contact with said actuator member, wherein said first decrease port and said second decrease port are connected at a same side of said housing and act on a same side of said actuator to exert a control force on said actuator in one direction based on said pressures in said first decrease port and said second decrease port;

a valve connected to said second decrease port for controlling the flow of fluid to said second decrease port;

a suction passage connected to said housing for drawing fluid into said housing using said actuator member; and a discharge passage connected to said housing wherein fluid exits said housing after said actuator member pressurizes said fluid.

2. The pump of claim 1, further comprising an electronic control unit operably associated with said valve, wherein said electronic control unit is selectively operable to provide an input control signal to said valve for controlling oil flow and oil pressure.

3. The pump of claim 2, wherein the electronic control unit monitors one or more engine conditions selected from the group consisting of engine speed, engine temperature, engine load, wherein said electronic control unit selectively adjusts the flow of fluid through said pump in response to said engine conditions.

4. The pump of claim 2, wherein said valve is a solenoid valve operable to regulate pressure supplied to said second decrease port in response to the current supplied to the solenoid valve.

5. The pump of claim 1, wherein actuator member is a vane pump.

6. The pump of claim 1 wherein said actuator member further comprises an eccentric ring and a moveable portion, wherein said eccentric ring acts on said movable portion to control the flow of fluid generated by said pump.

7. The pump of claim 6, further comprising a biasable member operably associated with said eccentric ring, wherein the first biasable member is selectively operable to cause the actuating member partially control the flow generated by the pump.

8. The pump of claim 6, wherein said first decrease port and said second decrease port are in operable contact with said eccentric ring to and said flow generated by said pump is partially controlled by the combined pressure of said first decrease port and said second decrease port acting on said eccentric ring.

9. The pump of claim 8, wherein said pump operates in a high pressure mode when said valve closes and restricts the pressure in said second decrease port.

10. The pump of claim 8, wherein said pump operates in a low pressure mode when said valve opens and increases the pressure in said second decrease port.

11. A pump comprising:

a housing;

an actuator member contained in said and generating flow through said pump, wherein said actuator member is positioned between a decrease chamber and a biasable member;

a first decrease port connected to said decrease chamber, said first decrease port having a surface area in operable contact with said actuator member;

a second decrease port connected to said decrease chamber in to said decrease chamber, said second decrease port having a surface area in operable contact with said actuator member, wherein said first decrease port and said second decrease port are connected at a same side of said housing and act on a same side of said actuator to exert a control force on said actuator in one direction based on said pressures in said first decrease port and said second decrease port;

a valve connected to said second decrease port for controlling the flow of fluid to said second decrease port;

a suction passage connected to said housing for drawing fluid into said housing using said actuator member; and a discharge passage connected to said housing wherein fluid exits said housing after said actuator member pressurizes said fluid.

12. The pump of claim 11, further comprising an electronic control unit operably associated with said valve, wherein said electronic control unit is selectively operable to provide an input control signal to said valve for controlling oil flow and oil pressure.

13. The pump of claim 12, wherein the electronic control unit monitors one or more engine conditions selected from the group consisting of engine speed, engine temperature, engine load, wherein said electronic control unit selectively adjusts the flow of fluid through said pump in response to said engine conditions.

14. The pump of claim 12, wherein said valve is a solenoid valve operable to regulate pressure supplied to said second decrease port in response to the current supplied to the solenoid valve.

15. The pump of claim 11, wherein actuator member is a vane pump.

16. The pump of claim 11 wherein said actuator member further comprises an eccentric ring and a moveable portion, wherein said eccentric ring positioned between said decrease chamber and acting on said biasable member and said movable portion to control the flow of fluid generated by said pump.

17. The pump of claim 16, wherein said biasable member operably associated with said eccentric ring, wherein said biasable member is selectively operable to cause the actuating member partially control the flow generated by the pump.

18. The pump of claim 17 wherein said biasable member contacts said eccentric ring to cause said pump to increase in flow when said eccentric ring is moved with said biasable member to an extended position.

19. The pump of claim 18, wherein said first decrease port and said second decrease port are in operable contact with said eccentric ring to and said flow generated by said pump is decreased when said first decrease port and said second decrease port apply pressure to said eccentric ring.

20. The pump of claim 16, wherein said first decrease port and said second decrease port are in operable contact with said eccentric ring to and said flow generated by said pump is partially controlled by the combined pressure of said first decrease port and said second decrease port acting on said eccentric ring.

21. The pump of claim 20, wherein said pump operates in a high pressure mode when said valve closes and restricts the pressure in said second decrease port.

22. The pump of claim 20, wherein said pump operates in a low pressure mode when said valve opens and increases the pressure in said second decrease port.

23. A pump comprising:

a housing;

an actuator member contained in said housing having a movable vane rotatably positioned in an eccentric ring for generating flow through said pump, wherein said eccentric ring is positioned between a decrease chamber and a biasable member;

a first decrease port connected to said decrease chamber, said first decrease port having a surface area in operable contact with said actuator member;

a second decrease port connected to said decrease chamber in to said decrease chamber, said second decrease port having a surface area in operable contact with said actuator member, wherein said first decrease port and said second decrease port are connected at a same side of said housing and act on a same side of said actuator to exert a control force on said actuator in one direction based on said pressures in said first decrease port and said second decrease port;

a solenoid ball valve connected to said second decrease port for controlling the flow of fluid to said second decrease port;

a suction passage connected to said housing for drawing fluid into said housing using said actuator member; and a discharge passage connected to said housing wherein fluid exits said housing after said actuator member pressurizes said fluid.

* * * * *